United States Patent [19]

Gardner et al.

[11] 4,008,870

[45] Feb. 22, 1977

[54] RAILROAD TRACK ALARM

[75] Inventors: Harry R. Gardner, White Rock; Charles D. Marlatt, North Vancouver, both of Canada

[73] Assignee: Western Railspan Inc., White Rock, Canada

[22] Filed: Apr. 21, 1975

[21] Appl. No.: 570,274

[30] Foreign Application Priority Data

Feb. 25, 1975 Canada ..... 220944

[52] U.S. Cl. ..... 246/120; 200/61.42; 246/217; 340/421

[51] Int. Cl.[2] ..... B61L 23/04; H01H 3/02

[58] Field of Search ..... 116/67 R, 3, 124 L; 33/144, 146; 238/339; 200/61.69, 82 C, 61.42, 153 B, 61.46, 153 H; 340/282, 241, 421; 246/217, 120, 251, 1 C

[56] References Cited

UNITED STATES PATENTS

| | | | |
|---|---|---|---|
| 551,622 | 12/1895 | Donovan et al. | 33/144 |
| 626,903 | 6/1899 | Gumbes, Jr. | 246/217 |
| 1,155,373 | 10/1915 | Romig | 246/251 |
| 1,168,449 | 1/1916 | Winstead | 238/339 X |
| 1,408,395 | 2/1922 | Pokorny | 238/339 |
| 2,418,508 | 4/1947 | Goepfrich | 200/82 C |
| 2,557,254 | 6/1951 | Bovard | 116/67 R X |
| 2,958,858 | 11/1960 | Eversole | 340/280 |
| 3,885,116 | 5/1975 | Kodaira | 116/124 Z |

*Primary Examiner*—Donald O. Woodiel
*Assistant Examiner*—Daniel M. Yasich
*Attorney, Agent, or Firm*—Fetherstonhaugh & Co.

[57] ABSTRACT

A railroad track alarm. The alarm comprises a switch box mountable between the rails of a railroad track. There are openings in the ends of the switch box and first and second switches located in the switch box. Two rods extend outwardly from inside the switch box through the openings, one rod towards each rail of the track when the alarm is in its useful position between the rails. The alarm has means urging each rod outwardly. Each rod is linked to a switch so that when the rods move outwardly relative to each other by a first amount the first switch is tripped and when the rods move outwardly relative to each other by a second amount, larger than the first, the second switch is tripped. The alarm is simple to set. Unlike prior art alarms it sets an alarm for wide gauge and for other track damage.

14 Claims, 7 Drawing Figures

RAILROAD TRACK ALARM

This invention relates to a railroad track alarm.

Alarms designed to operate when a track is damaged are well known in the art. In particular, so-called "wide gauge alarms", which are designed to signal when a railroad track has widened beyond the safe limits are well known. Similarly, alarms are known that are operated if a rock slide blocks a track, and alarms are known that are designed to operate if a wheel of a train or carriage has left the track or if something is hanging down from the train or the carriage.

The prior art devices generally only indicate either that the track has widened or that the track has become damaged. This may not be sufficient, particularly in mountainous regions where rail tracks are prone to widening and where rock or snow slides may be common. With a rock or snow slide it is possible that the gauge of the track will not be altered and a wide gauge alarm will thus not show a blockage of the track. None of the prior art devices combine the two functions of tripping an alarm when the track is widened but not necessarily otherwise damaged and tripping an alarm when the track is blocked or damaged but not necessarily widened.

Accordingly, the present invention is a railroad track alarm that comprises a switch box mountable between the rails of a railroad track; openings in the ends of the switch box; first and second switches located in the switch box; two rods extending outwardly from inside the switch box through the openings, one rod towards each rail of the track when the alarm is in its useful position between the rails; means urging each rod outwardly; means linking each rod to a switch so that when the rods move outwardly relative to each other by a first amount the first switch is tripped and when the rods move outwardly relative to each other by a second amount, larger than the first, the second switch is tripped. In position on a railroad track, the first switch operates a wide gauge alarm, the second switch operates a track damage alarm.

In one embodiment of the invention, the first and second switches are mounted on the end of one rod, for example on a plate attached to the rod, and a lever extends from each switch to contact the sides of the second rod at varying distances from the end of the second rod. The levers are loaded to tend to make them move inwardly towards the longitudinal axis of the second rod so that, when the rods move outwardly relative to each other by the first amount, the lever of the first switch ceases to contact the side of the second rod and moves inwardly to trip the first switch. When the rods move outwardly relative to each other by the second amount the lever of the second switch ceases to contact the side of the second rod and moves inwardly to trip the second switch.

In a further embodiment each switch has a lever extending to contact a pair of joined arms that can move relative to each other about the joint. Each arm of each pair of arms is attached at the end remote from the lever to one of the rods at varying distances from the end of the rod, one arm of each pair of each rod. The arms from the lever of the second switch are attached to the rods at a point nearer the ends of the rods then the arms of the lever of the first switch.

It is desirable that the rods be marked in the vicinity of the openings in the ends of the switch box. This enables simple inspection to determine if either rod has moved outwardly and provides a means of showing whether the track has widened since the alarm was installed or since the last inspection of the alarm. For example, the rods may be coloured in the vicinity of the openings in the ends of the switch boxes. This colouring may be carried out in such a way that the projection of the coloured portion out of the switch box can indicate that a rod has moved outwardly.

Desirably the rods are urged outwardly by spring loading. In a preferred embodiment each rod has a first abutment means associated with it that is inside the switch box and fixed relative to the box. The rod is movable relative to the abutment means. Second spring abutment means are mounted on the rod, again inside the box, and fixed relative to the rod. A spring is positioned between the first and second abutment means to urge the rod outwardly. The alarm of this embodiment has the advantage that the switch box protects the abutment means and the spring from the weather and from rocks and other objects that could break the mechanism.

In a preferred embodiment of the invention each rod has a cavity at its end. Two shafts, each shaped at its first end to enter the cavity in a rod and each adapted at its second end to engage a mounting associated with a rail of the track, extend from the cavity in the rod to the mounting. Preferably the rods and shafts are of rolled steel but the interengagement of the cavitied ends of the rods and the shaped ends of the shafts is such that the shafts can be dislodged from the rods by a vigorous blow whereby to activate the alarm.

In another embodiment of the invention, the shafts are made from a material which is breakable by a vigorous blow. Thus, the shafts can be shattered to allow the rods to move endwise whereby to activate the alarm.

The mounting associated with the rail is preferably a member that is Y-shaped at one end to engage a flange of the rail. This mounting is preferably formed with a cavity at its other end to receive the second end of the shaft but the mounting may also be attached to the shaft. This Y-shaped mounting is generally positioned in a cavity formed in a tie plate. Using this mounting if the rail of a track moves longitudinally it can simply slide within the Y-shaped end of the mounting member without setting off an alarm.

The invention is illustrated, by way of example, in the accompanying drawings in which.

Figures 1, 2, 3, 4, 5:
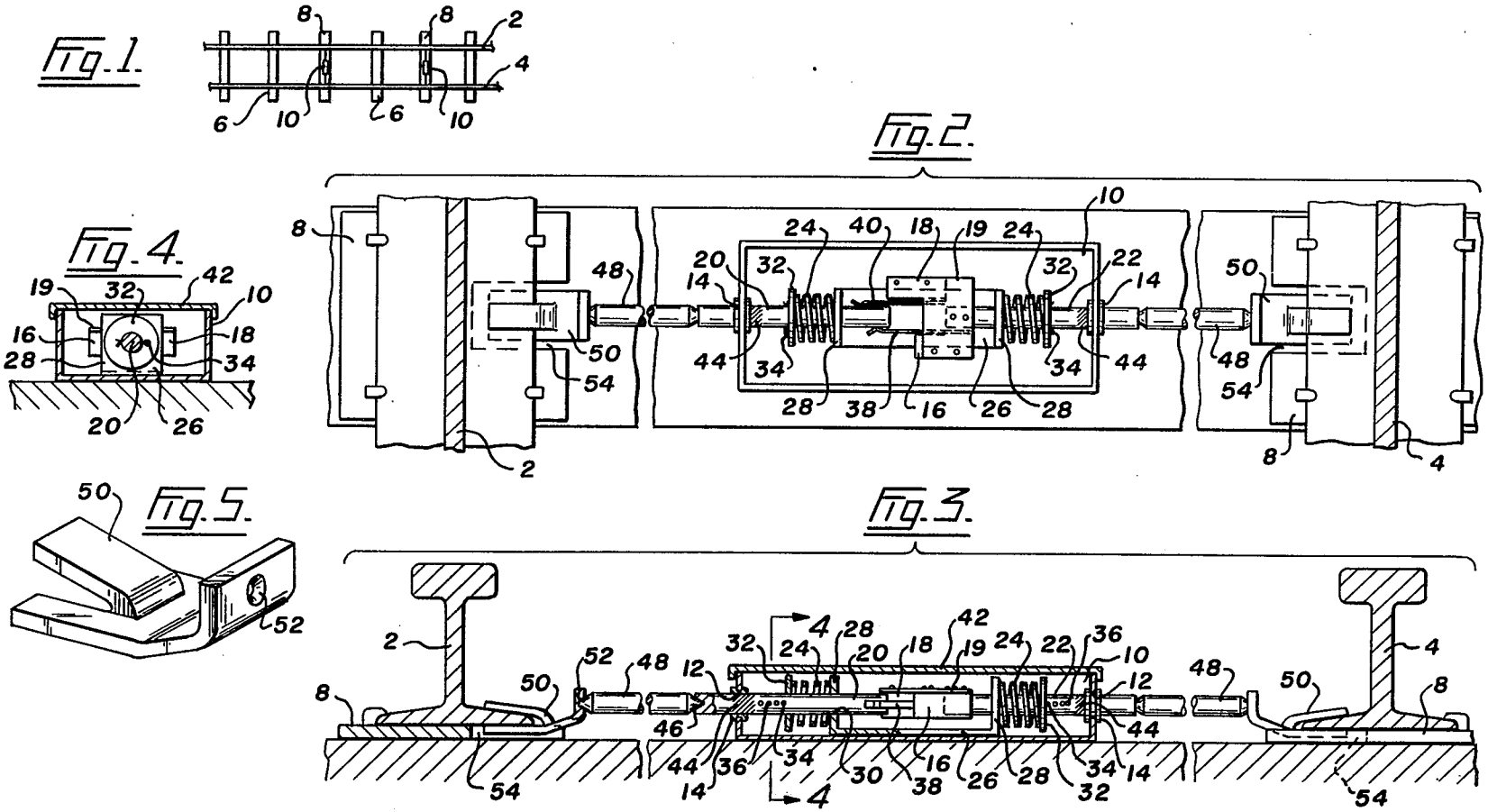
FIG. 1 illustrates the positioning of an alarm according to the present invention on a railroad track.
FIG. 2 is a plan view of one embodiment according to the present invention.
FIG. 3 is a sectional elevation of the embodiment illustrated in FIG. 2.
FIG. 4 is a section along the line 4—4 in FIG. 3.
FIG. 5 illustrates the mounting member shown in FIGS. 2 and 3.

In the drawings, FIG. 1 shows a railroad track composed of rails 2 and 4 mounted on ordinary railroad ties 6 and ties 8 modified to receive the alarm indicated generally by reference to box 10.

In FIG. 2 the alarm is shown to comprise a switch box 10 mounted between the rails 2 and 4 of a railroad track. The box 10 has openings 12 in each of its ends.

In the illustrated embodiment the holes 12 are provided with seals 14. A first switch 16 and a second switch 18 are located in the box 10. The switches 16 and 18 are mounted on a plate 19 bolted to the end of rod 22. Rods 20 and 22 extend outwardly from inside the switch box 10 through openings 12. Rod 20 extends towards rail 2; rod 22 extends towards rail 4.

There are means urging each rod 20 and 22 outwardly. In the embodiment of FIGS. 2 to 4 these means urging the rods outwardly are springs 24, one mounted on each rod. In the embodiment of FIG. 2 to 4 the alarm is provided with a cradle 26, best shown in FIG. 3. This cradle has upstanding limbs 28 that provide abutments means for the springs 24. The cradle 26 is fixed relative to the box 10. However, as shown most clearly in FIG. 3, rod 20 extends through a hole 30 in one of the limbs 28 of the cradle 26. Rod 22 extends through a similar hole in the other limb 28 in the cradle 26. Rods 20 and 22 are provided with second spring abutment means in the form of collars 32 mounted on each rod 20 and 22 inside the box 10. These collars 32 are retained on the rod by pins 34 inserted through holes 36 to fix the collars relative to the rods 20 and 22, at least when the springs 24 are in position.

There are means linking each rod 20 and 22 to the first switch 16 and the second switch 18. A lever 38 extends from first switch 16, mounted on the plate 19 on rod 22, to contact the side of rod 20. A lever 40 extends from the second switch 18 mounted on the plate 19, also to contact the side of the rod 20. Levers 38 and 40 contact the sides of rod 20 at varying distances from the end of the rod 20. Levers 38 and 40 are loaded to tend to make them move inwardly, that is towards the axis of rod 20. Thus, when the rods 20 and 22 move outwardly relative to each other by a first amount greater than the amount by which the lever 38 first overlapped the end of the rod 20, lever 38 moves inwardly to trip first switch 16. Similarly, when the rods 20 and 22 move outwardly relative to each other by a second amount, greater than the first amount, and at least equal to the amount by which the lever 40 orginally overlapped the end of the rod 20, lever 40 ceases to contact the side of rod 20 and moves inwardly to trip the switch 18.

Switch box 10 has a top 42. Rods 20 and 22 are marked with bands of colour 44. When the coloured bands 44 project through the seal 14 it is immediately apparent upon inspection that the rod 20 has moved outwardly from the switch box 10. This is a clear indication that the gauge of the track has increased.

The rods 20 and 22 are each provided with a cavity 46 at their ends. Cavities 46 are formed in those ends of the rods 20 and 22 adjacent the ends of the rails 2 and 4 respectively. A shaft 48 engages the cavity 46 in each rod 20 and 22. The shafts 48 also each engage a mounting 50, one associated with rail 2 and the other associated with rail 4. The shafts 48 preferably are each made of a sturdy material, for example rolled steel.

The mounting 50 is best shown in FIG. 5. The mounting 50 is Y-shaped at one end to engage a flange of the rail 2 or the rail 4. At its other end the mounting 50 is formed with a cavity 52 adapted to engage an end of the shaft 48. In the illustrated embodiment the cavity 52 resembles in shape cavity 46 in the rods 20 and 22 which facilitates the positioning of the shafts 48. The mounting 50 is positioned on a special tie bar 8 provided with a cavity 54 to receive the lower part of the Y-shaped end of the mounting 50.

To use, the railroad track alarm of FIGS. 2 to 4 is positioned on a railroad track as indicated in FIG. 1. The alarm is set up as indicated in FIG. 2. That is, it is arranged so that the levers 38 and 40 of the switches 16 and 18 overlay the sides of the rod 20 by a predetermined amount. The overlap of lever 38 is arranged in such a way that it represents the maximum permissible amount by which the gauge of the track can widen and still be safe. This amount of overlap is controlled by the adjustment of the collars 32. Depending upon the strength of the springs 24, the collars 32 are moved to a position that ensures that the overlap of lever 38 on the rod 20 is the correct, predetermined position. When the alarm is set up the springs 24 are constantly tending to urge the rods 20 and 22 outwardly. Thus if the gauge of the track widens the relative outward movement of the rails 2 and 4 causes the rods 20 and 22 to separate the same amount, under the urging of the springs 24. If the rods 20 and 22 move outwardly relative to each other by an amount greater than the original overlap of lever 38 on rod 20 then lever 38 cannot contact the side of the rod 20 and thus moves inwardly. In doing so it trips the first switch 16.

The overlap of lever 40 on rod 20 need not be set as precisely as the overlap of lever 38 on rod 20. However, the overlap of lever 40 must be greater than the overlap of lever 38. If the railroad track is subject to a rock or snow fall or if a train passes over the track with a part hanging down, for example if a wheel of a train or of a carriage has left the track and is running on the inside of the rail, one or both of the shafts 48 is displaced or dislodged from engagement with a rod 20 and mounting 50. The rod 20 or 22 originally engaged with the displaced shafts 48 is forced outwardly by the extension of the spring 24 which, of course, is released by the displacement of the shaft 48. Lever 40 is able to move outwardly, as described above for lever 38, towards the longitudinal axis of the rod 20 and switch 18 is tripped.

The switches 16 and 18 may be attached to any known alarm but preferably they are connected to small radio transmitters that emit one signal when switch 16 is tripped and a different signal when switch 18 is tripped. The signal can be picked up on a train or patrolman's radio with a desired distance, for example, 1 mile from the alarm.

Figure 6:
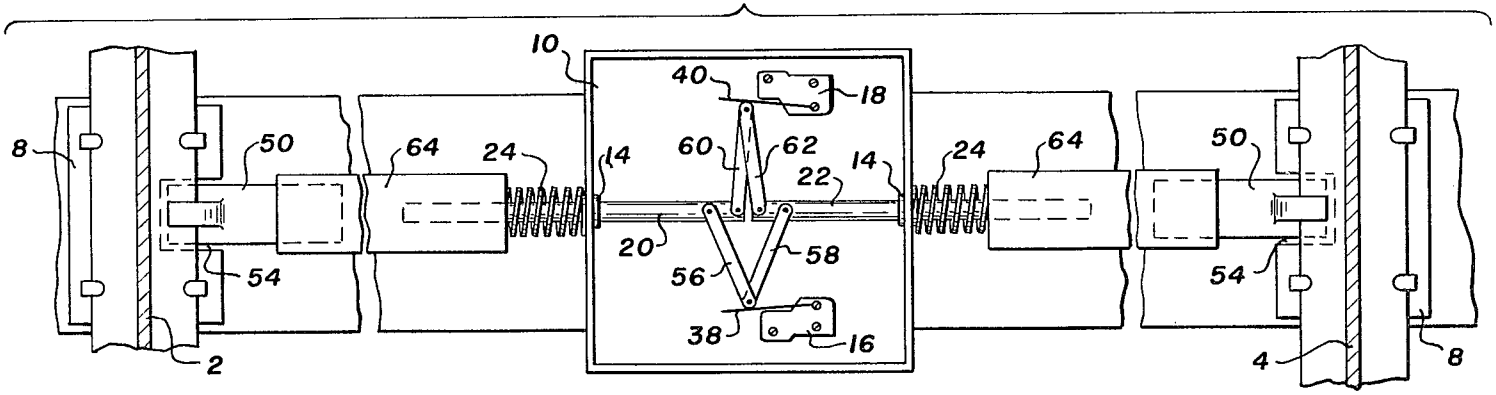
FIG. 6 is a plan view of a further embodiment of the present invention.
Figure 7:
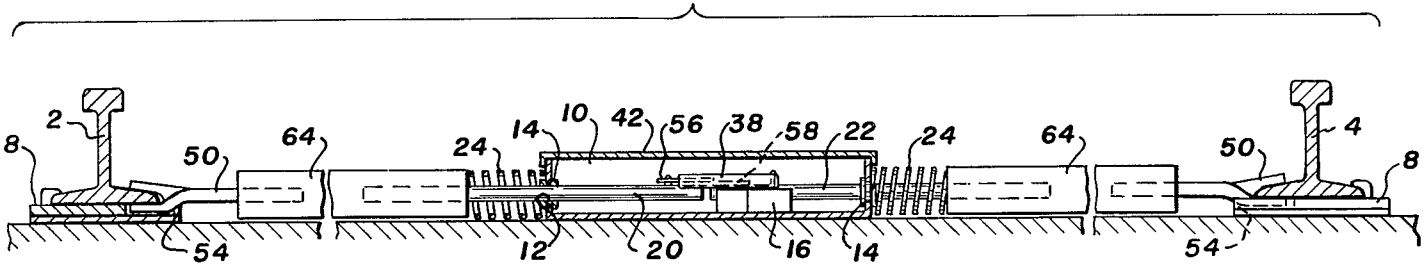
FIG. 7 is an elevation of the embodiment illustrated in FIG. 6.

FIGS. 6 and 7 have the same reference numerals for parts that are also shown in FIGS. 1 to 5. Thus FIGS. 6 and 7 illustrate a switch box 10 mountable between the rails 2 and 4 of a railroad track. The box 10 has openings 12 in the ends of the switch box. There are seals 14 in the holes 12. A first switch 16 and a second switch 18 are located within the switch box 10. Rods 20 and 22 extend outwardly from inside the switch box 10 through the openings 12. Springs 24 comprise a means of urging the rods 20 and 22 outwardly, towards rails 2 and 4. Tie plates 8 are provided with cavities 54 which receive the Y-shaped ends of a mounting 50.

However, the embodiment of FIG. 6 and 7 differs in some important respects. In FIG. 6 and 7 each switch 16 and 18 has a lever, 38 and 40 respectively, extending from it, as in the embodiment of FIGS. 2 to 4. However, the lever 38 extends to contact a pair of joined arms 56 and 58. Lever 40 extends to contact a pair of joined arms 60 and 62. Each arm 56 and 60 is attached at the end remote from the lever 38 and 40 respectively to rod 20. Similarly, each arm 58 and 62 is attached to rod 22. Arms 60 and 62, which extend from the lever 40 of the second switch 18, are attached to rods 20 and 22 respectively at points nearer the ends of the rods 20 and 22 than the attachment of the arms 56 and 58.

Further, in the embodiment of FIG. 6 and 7, the rods 20 and 22 are each attached to one end of the shaft 64 of a material breakable by a vigorous blow. The other end of the shafts 64 are attached to the mountings 50 which are embedded in the shafts 64. The springs 24 are positioned outside the box 10 and the end of each shaft 64 adjacent the box 10 makes an abutment means for each spring 24. The other end of the spring 24 abuts the exterior of the box 10.

The embodiment of FIG. 6 and 7 is positioned between the rails of the track by compressing the springs 24 sufficiently to enable the mountings 50 to engage the flanges of the rails 2 and 4. The embodiment of FIGS. 6 and 7 is set up in such a way that once the mountings 54 engage the sides of the rails 2 and 4 the rods 20 and 22 are in an appropriate initial setting. If the track widens the rods 20 and 22 move outwardly under the urging of the springs 24. At a certain predetermined widening the levers 56 and 58 will have moved so far from their initial position that the switch 16 is tripped. Similarly if the shafts 64 are broken the rods 20 and 22 move outwardly to the maximum distance caused by the full expansion of the springs 24. The arms 60 and 62 thus are moved such a distance that the switch 18 is tripped by the force exerted on the lever 40. The first switch 16, operates a wide gauge alarm, the second switch 18 operates a track damage alarm.

The track alarm of the present invention should clearly be of robust construction. In the main all parts will be of steel. The shafts 64 are, as indicated above, of a material that can be broken by a vigorous blow.

The invention is not restricted to the embodiments described in FIGS. 2 to 4 and 6 and 7. It will be appreciated that features shown in the embodiments of FIGS. 2 to 4 can be combined with features shown in the embodiment of FIGS. 6 and 7. In particular, the attachment of the shaft 64 shown in FIGS. 6 and 7 is not generally as desirable as the engagement of rod 48 shown in FIGS. 2 and 3. It follows that the mountings 50 illustrated in FIG. 5, each having a cavity 52, are generally preferred to the mountings shown in FIGS. 6 and 7. A further desirable feature of the embodiment of FIGS. 2 and 3 is the positioning of the springs 24 inside the switch box 10. Clearly there is less likelihood of damage if the springs are positioned inside the switch box 10. Similarly the coloured bands 44 on the rods 20 and 22 shown in FIG. 3 can be incorporated in the embodiments of FIGS. 6 and 7 although the external positioning of the springs 24 of FIGS. 6 and 7 may prove a slight disadvantage in inspecting to see if the coloured portions 44 are projecting from the box 10. In this matter, it should also be noted that the coloured band 44 can easily be replaced by a series of calibrating marks indicating the amount of movement of each of the rods 20 and 22 since installation.

Typically the alarm of the invention may be installed on every other tie plate in areas of track prone to damage, for example on curves in the mountains. In other places the frequency need not be as high.

It will be noted the shafts 48 are displaceable by virtue of their coned ends being received in cavitated ends of the rods and mounting and thus can be dislodged from the rods by a heavy blow. The shafts 64 are displaceable by being shattered in response to a heavy blow with the end result being the same as before, viz., the rods can move endwise to trip the alarm. The blow required to displace the shafts 48 and 64 is one of approximately 350 pounds. Thus, a person could not step on the shafts, or even jump up and down thereon, and thereby exert a force sufficient to dislodge a shaft 48 or shatter a shaft 64 so as to cause a false alarm. Both embodiments of the invention effectively serve as dragging equipment detectors for trains and the track alarms are extremely difficult to set off by anyone tampering with the equipment.

What we claim is:

1. A railroad track alarm actuator comprising:
a switch box mountable between the rails of a railroad track;
openings in the ends of the switch box;
first and second switches located in the switch box;
two rods extending outwardly from inside the switch box through the openings, each one of said rods connected by means to each rail of the track when the alarm actuator is in its useful position between the rails;
means resiliently urging each rod outwardly;
means linking each rod to one of the switches in the switch box so that when the rods move outwardly relative to each other by a first amount the first switch is tripped so as to operate a track wide gauge alarm means and when the rods move outwardly relative to each other by a second amount, larger than the first, the second switch is tripped so as to operate a track damage alarm means.

2. An actuator as claimed in claim 1 in which the first and second switches are mounted on the end of one rod and a lever extends from each switch to contact the sides of the second rod at varying distances from the end of the second rod; the levers being loaded to tend to make them move toward the longitudinal axis of the second rod so that, when the rods move outwardly relative to each other by the first amount the lever of the first switch ceases to contact the side of the second rod and moves inwardly to trip the first switch, and when the rods move outwardly relative to each other by the second amount the lever of the second switch ceases to contact the side of the second rod and moves inwardly to trip the second switch.

3. An actuator as claimed in claim 1 in which each switch has a lever extending to contact a pair of joined arms, each arm of each pair of arms being attached at the end remote from the lever to one of the rods at varying distances from the end of the rod, one arm of each pair to each rod, the arms from the lever of the second switch being attached to the rods at a point nearer the ends of the rods than the arms of the lever of the first switch.

4. An actuator as claimed in claim 1, in which the rods are marked in the vicinity of the openings in the ends of the switch boxes to enable simple inspection to determine if either rod has moved outwardly.

5. An actuator as claimed in claim 1 in which the rods are coloured in the vicinity of the openings in the ends of the switch boxes.

6. An actuator as claimed in claim 5 in which the rods are coloured in such a way that the projection of the coloured portion out of the switch box indicates that the rod moved outwardly.

7. An actuator as claimed in claim 1 in which the means resiliently urging each rod outwardly comprises spring loading.

8. An actuator as claimed in claim 7 in which each rod has a first abutment means associated with it that is inside the switch box and fixed relative to the box, each rod being movable relative to the associated abutment means;

second spring abutment means mounted on each rod inside the box and fixed relative to the corresponding rod at least when the alarm is in its useful position;

a spring positioned between the first and second abutment means of each rod to urge the associated rod outwardly.

9. An actuator as claimed in claim 7 in which each rod is provided with abutment means for a spring, the means being fixed relative to the rod and positioned outside the switch box, and a spring positioned between the end of the switch box and the abutment means to urge the rod outwardly.

10. An actuator as claimed in claim 1 in which each rod is attached to one end of a corresponding shaft comprised of a material breakable by a vigorous blow such that said shafts are displaceable by being shattered out of engagement with the associated rods, the other end of each shaft being adapted to engage a mounting associated with a rail of the track.

11. An actuator as claimed in claim 10 in which the mounting associated with each rail is a member that is Y-shaped at one end to engage a flange of the rail, the other end being attached to the shaft.

12. An actuator as claimed in claim 1 in which each rod has a cavity in its end; and further comprising two shafts, each adapted at its first end to engage the cavity in an associated rod and adapted at its second end to engage a mounting associated with a rail of the track, each shaft being displaceable by being dislodged from the associated rod when struck a vigorous blow.

13. An actuator as claimed in claim 12 in which the mounting associated with each rail is a member that is Y-shaped at one end to engage a flange of the rail and formed with a cavity at its other end adapted to receive the second end of the associated shaft.

14. An actuator as claimed in claim 12 in which the shafts are made of rolled steel.

* * * * *